United States Patent [19]

Katz

[11] 4,084,696

[45] Apr. 18, 1978

[54] BIND-IN INSERT

[76] Inventor: Robert E. Katz, 17 Camelot Dr., Livingston, N.J. 07039

[21] Appl. No.: 669,878

[22] Filed: Mar. 24, 1976

[51] Int. Cl.[2] ..... B65D 27/34

[52] U.S. Cl. ..... 206/629; 206/632; 283/56; 229/68 R

[58] Field of Search ..... 229/68 R, 73, 85, 66; 282/25, 8 R, 8 A, 8 B, 8 C; 281/21 R; 283/56; 206/629, 632

[56] References Cited

U.S. PATENT DOCUMENTS

| | | | |
|---|---|---|---|
| 671,968 | 4/1901 | Kittredge | 229/68 R |
| 1,720,721 | 7/1929 | Culotta | 229/85 |
| 2,145,500 | 1/1939 | Townsend | 229/68 R X |
| 2,180,551 | 11/1939 | Sawdon et al. | 229/68 R X |
| 2,927,803 | 3/1960 | Milne | 282/8 R X |
| 3,159,329 | 12/1964 | Hiersteiner | 229/68 R |
| 3,268,153 | 8/1966 | Stone | 229/68 R |
| 3,347,449 | 10/1967 | Behal | 229/68 R |
| 3,369,732 | 2/1968 | Hanson | 229/68 R |
| 3,560,025 | 2/1971 | Ostrander | 229/68 R X |

*Primary Examiner*—Stephen P. Garbe
*Attorney, Agent, or Firm*—Shlesinger, Arkwright, Garvey & Dinsmore

[57] ABSTRACT

A bind-in insert of lightweight paper stock for use in magazines, catalogs and booklets, has a paper envelope and a narrow, elongated, and impermeable thickened binding strip section disposed along the edge to be bound, the binding strip being formed by folding over and gluing the edge portion of the insert.

4 Claims, 7 Drawing Figures

Fig. 1
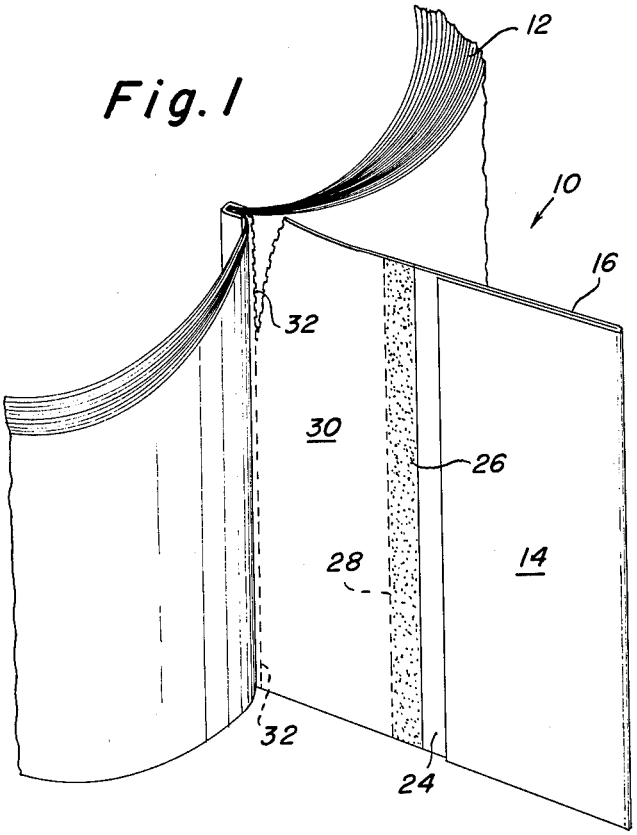
Fig. 2
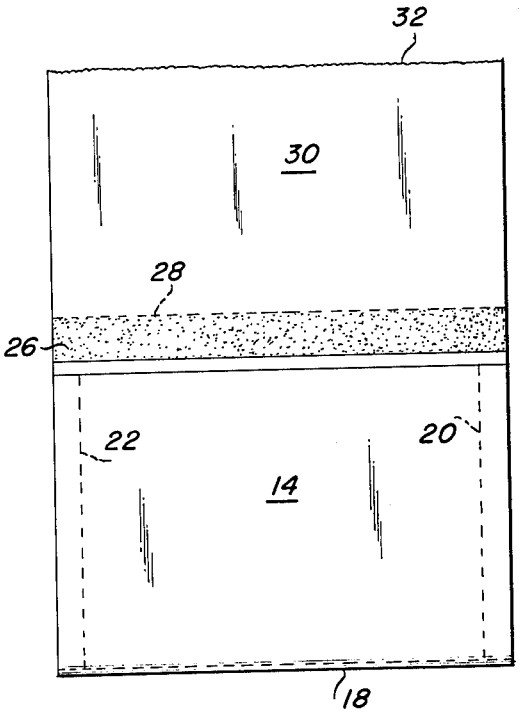
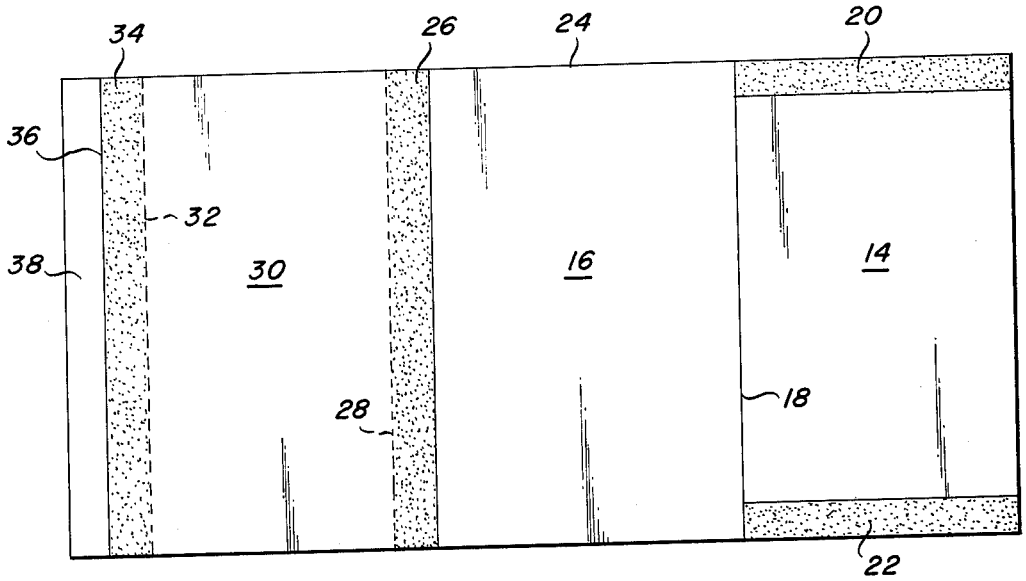
Fig. 3

Fig. 4
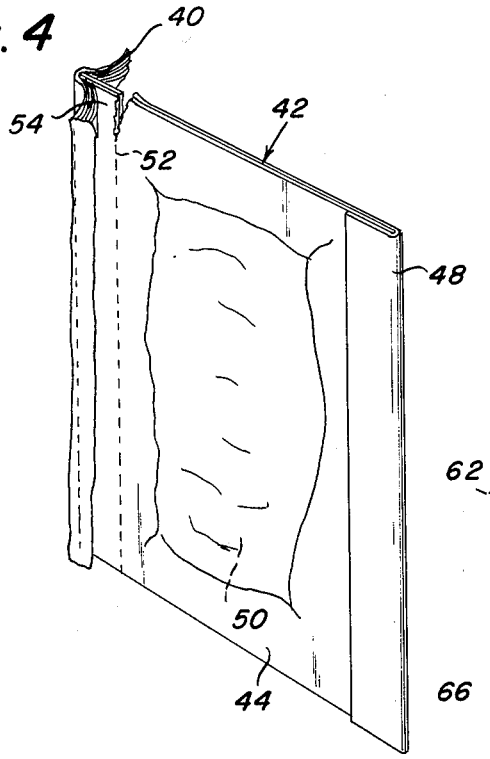
Fig. 5
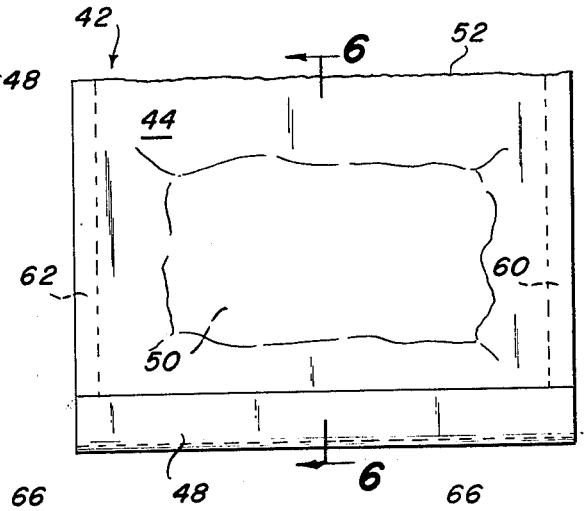
Fig. 7
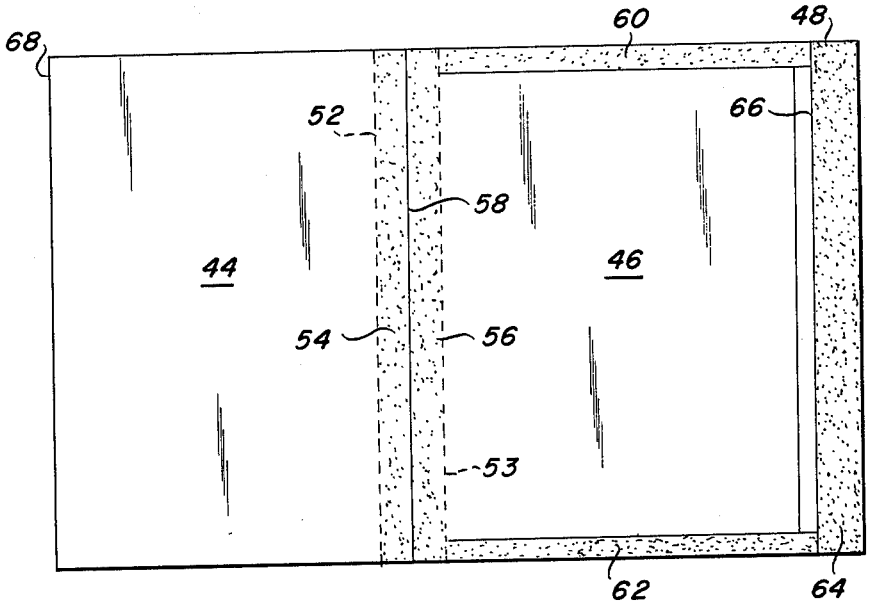
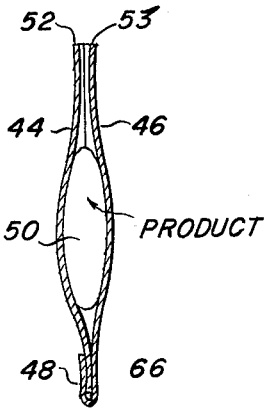
Fig. 6

BIND-IN INSERT

BACKGROUND OF INVENTION

In machine binding operations for catalogs and booklets where inserts are to be added, there has been difficulty encountered with binding of such items by automatic equipment.

The machinery used for placing such insert items in a stack of pages to be bound frequently picks up more than one insert, where such items are made of lightweight paper stock.

The instant invention remedies this situation and, also makes it possible to readily remove the bound-in item from the completed publication.

SUMMARY OF INVENTION

This invention relates to a bind-in piece for bound publications, and particularly to such items that are to be removed from a bound catalog.

One of the principal advantages of the invention is the provision of an insert piece which can readily be made of thin paper stock material and will not cause difficulty when used with book binding equipment.

A further advantage of the invention is the provision of an integral binding element for a catalog insert.

A further advantage of the invention is the providing of a simple machine operation formed element as an integral part of a binding insert which will both bind in a piece in a catalog and also provide for ready removal thereof.

A still further advantage of the invention is incorporation of a special bind-in strip with an envelope insert, such that on removal of the envelope from the catalog, a closed and previously sealed sample containing envelope is automatically opened.

These and further advantages will become apparent to those skilled in the art.

DESCRIPTION OF THE DRAWINGS

FIG. 1 is a perspective view of a catalog showing one form of bind-in insert;

FIG. 2 is a plan view of the insert of FIG. 1, after removal from the catalog;

FIG. 3 is a plan view of the bind-in envelope insert blank prior to folding;

FIG. 4 is a perspective view of the catalog showing a sample containing envelope having a bind-in strip;

FIG. 5 is a plan view of the sample containing envelope of FIG. 4 after removal from the catalog;

FIG. 6 is a cross-sectional view of the sample containing envelope of FIG. 5 along line 6—6;

FIG. 7 is a plan view of the envelope blank prior to folding.

DESCRIPTION OF THE INVENTION

Referring particularly to the drawings, FIG. 1 shows the bind-in insert generally indicated at 10 as it is about to be removed from a magazine or catalog 12.

As seen in FIGS. 1–3, the bind-in insert includes an envelope having panels 14 and 16 formed by a lateral folding about line 18. Parallel glue lines 20 and 22 shown on panel 14, but which can be disposed on either panel, enclose the ends of the envelope. Fold line 18 becomes the bottom edge of the envelope. The envelope flap 24 has an elongated glue strip 26, adjacent which there is a perforated line 28.

The perforated line 28 permits the envelope to be readily separated from the coupon 30. The coupon will contain spaces for order information, advertising, etc. The coupon 30 at its other interior edge has an elongated transverse perforate line 32 which permits separation of the coupon from the elongated binding strip.

The bind-in strip is an elongated, narrow strip 34 to which glue has been applied. It is separated by a transverse fold line 36 which extends along strip section 38 of the binding strip. End strip 38 is folded along fold line 36 over onto the glue strip panel 34 to provide an imperforate relatively imporous piece. This elongated imperforate or imporous binding strip is engaged by and picked up by suction equipment in the course of making of the magazine or catalog and bound at that time.

It should be noted that the envelope as it is held in the magazine or catalog is open, and that the order coupon when torn from it and from the binding strip can readily be inserted in the envelope, which is then closed and mailed to the advertiser.

Another bind-in is shown in FIGS. 4 through 7. In this case, the magazine 40 has the bind-in insert generally indicated at 42. The envelope has front and rear panels 44 and 46, and the outer end of the envelope is closed by the folded over flap 48. A sample contained in the envelope, is generally indicated at 50.

The envelope is removed from the magazine or catalog 40 by tearing it free along the perforated lines 52 and 53 of panels 44 and 46 respectively to separate the envelope 42 from the catalog 40. The binding strip 54 remains in the catalog.

FIG. 5 shows the removed envelope 42 which is open at its top along line 52 so that the sample product 50 can be removed therefrom. This can be more clearly seen in FIG. 6 which is a sectional view of the envelope of FIG. 5 along line 6—6.

FIG. 7 shows the blank for the insert prior to folding. The panel 44 has an outer or bottom closing flap 48, while the inner portion is closed by the binding strip section formed by elongated sections 54 and 55 which are disposed on either side of a fold line 58. And these are located between the perforated lines 52 and 53. The sides of the envelope are closed by glue strips 60 and 62 which will come in contact with panel 44 when it is folded over about line 58. The closing section 48 has glue 64 applied along its inner surface which engages the outer surface of the panel 48 after it is folded over about line 58. Prior to folding, the product to be enclosed in the envelope is placed on panel 46 between the glue strip.

After folding, the insert has a sealed, folded type envelope closed at one side by flap 48 and at its ends by the glued portions 60 and 62. The side of the envelope adjacent the binding strip 54 is closed by the bind-in strip. The folded over pieces 54 and 56, either one of which can have glue applied to it, form the reinforced and imporous binding piece which is bound in the magazine 40. Flap fold line 66 is next to the plain edge 68.

The impermeable binding strip not only provides a closure for the envelope, but support for the envelope piece in the catalog. In addition, since it is imporous and thickened, the binding equipment works well on the binding strip and does not pick up more than one binding insert at a time — something that would not be possible if the relatively imporous binding strip of this type were not used.

It should be noted that in these two modifications that the binding strip is used with automatic binding equipment. The previous difficulty of picking up more than one piece of lightweight stock at a time is eliminated completely. In addition, the binding strip can be used as a closure for the envelope itself, so that when the envelope is removed from the catalog or magazine, the envelope will automatically be opened.

While this invention has been described, it will be understood that it is capable of further modification, and this application is intended to cover any variations,, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What I claim is:

1. A bind-in magazine assembly, comprising:

a. a magazine having a plurality of pages, b. a unitary bind-in insert formed from a single paper sheet including an envelope and a bind-in strip, the latter being bound between the pages of the magazine, c. the envelope being closed and containing a sample, d. the bind-in strip disposed along an edge of the envelope, and being impermeable, e. a line of separation disposed between the bind-in strip and the envelope along which the envelope can be severed from the bind-in strip to simultaneously move it from the magazine and open it to permit removal of the sample.

2. The bind-in magazine assembly as set forth in claim 1, wherein:

a. the line of separation includes opposed perforate lines on each panel of the envelope extending parallel to the length of the bind-in strip.

3. The bind-in magazine assembly as set forth in claim 1, wherein:

a. the bind-in strip is made of two folded sections which are glued together by a glue strip.

4. The bind-in magazine assembly as set forth in claim 1, wherein:

a. the envelope is formed by two opposed panels which are glued together along at least two edges.

* * * * *